US006774572B2

(12) United States Patent
Fukuzako

(10) Patent No.: US 6,774,572 B2
(45) Date of Patent: Aug. 10, 2004

(54) DRIVE CIRCUIT FOR DRIVING A CURRENT-DRIVEN DISPLAY UNIT

(75) Inventor: Shinichi Fukuzako, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/278,788

(22) Filed: Oct. 24, 2002

(65) Prior Publication Data

US 2003/0080687 A1 May 1, 2003

(30) Foreign Application Priority Data

Oct. 26, 2001 (JP) ..... 2001-328997

(51) Int. Cl.[7] ..... G09G 3/10
(52) U.S. Cl. ..... 315/169.1; 345/204
(58) Field of Search ..... 315/169.3, 160, 315/169.1; 345/204, 80, 82, 211, 212

(56) References Cited

U.S. PATENT DOCUMENTS 4,358,728 A * 11/1982 Hashimoto ..... 323/275
5,289,112 A 2/1994 Brown et al. ..... 323/315
6,445,222 B1 * 9/2002 Hidaka et al. ..... 327/108
6,459,322 B1 * 10/2002 Cho ..... 327/333

FOREIGN PATENT DOCUMENTS

| | | |
|---|---|---|
| EP | 0407065 A2 | 1/1991 |
| JP | 3-45364 | 2/1991 |
| JP | 6-204564 | 7/1994 |
| JP | 11-291550 A | 10/1999 |

* cited by examiner

*Primary Examiner*—James Clinger
*Assistant Examiner*—Thuy Vinh Tran
(74) *Attorney, Agent, or Firm*—Volentine Francos, PLLC

(57) ABSTRACT

A drive circuit includes an input node for receiving data and an output node. The drive circuit also includes a first MOS transistor of a first conductivity type and a second MOS transistor of the first conductivity type. The first MOS transistor has a source, a drain connected to the output node, and a gate connected to the input node. The second MOS transistor has a source, a drain connected to the source of the first MOS transistor, and a gate supplied with a predetermined potential level. The drive circuit also includes a resistance connected between the source of the second MOS transistor and a source node supplied with a source potential level.

6 Claims, 10 Drawing Sheets

DRIVE CIRCUIT FOR DRIVING A CURRENT-DRIVEN DISPLAY UNIT

BACKGROUND OF THE INVENTION

1. Field of the Invention

The present invention relates to a drive circuit for driving a current-driven display unit using organic electroluminescent devices (hereinafter called "EL devices"), light-emitting diodes (hereinafter called "LEDs"), etc. which respectively emit light according to the supply of currents.

This application is counterpart of Japanese patent applications, Ser. No. 328997/2001, filed Oct. 26, 2001, the subject matter of which is incorporated herein by reference.

2. Description of the Related Art

FIG. 1 is a circuit diagram showing the outline of a general display unit using EL devices.

The present display unit principally comprises a display panel 1001, a scan line drive circuit 1003, a data line drive circuit 1005, and a control circuit 1007.

The display panel 1001 has a plurality of scan lines COM1 through COMn, a plurality of data lines SEG1 through SEGm, and a plurality of EL devices EL11 through ELnm respectively placed at points where the scan lines and the data lines intersect one another.

The scan line drive circuit 1003 comprises a plurality of switch means SWc1 through SWcn respectively electrically connected to the plurality of scan lines COM1 through COMn. The switch means SWc1 through SWcn electrically connect their corresponding scan lines COM1 through COMn to either a ground potential GND (e.g., 0V) or a scan line source potential Vc (e.g., 20V).

The data line drive circuit 1005 principally comprises a plurality of switch means SWs1 through SWsm respectively electrically connected to the plural data lines SEG1 through SEGm, and a plurality of constant current devices CC1 through CCm. The switch means SWs1 through SWsm electrically connect their corresponding data lines SEG1 through SEGm to the ground potential GND or the constant current devices CC1 through CCm. The constant current devices CC1 through CCm are respectively electrically connected to the data line source potential Vs (e.g., 20V).

The control circuit 1007 controls the operations of the switch means SWc1 through SWcn and the switch means SWs1 through SWsm, based on control data.

The states of the individual switch means at the time that only the EL device EL11 is in a light emitting state, are shown in FIG. 1. The light emitting state and non-light emitting state of the EL device will be described below in brief.

The cathode of the EL device EL11, i.e., the scan line COM1 is supplied with the ground potential GND by the switch means SWc1 of the scan line drive circuit 1003. Incidentally, when the ground potential GND is supplied to the corresponding scan line, the scan line is defined as an active state or a selected state. On the other hand, when the scan line source potential Vc is supplied thereto, it is defined as an inactive state or a non-selected state. Accordingly, the scan line COM1 is in an active state at present.

On the other hand, the anode of the EL device EL11, i.e., the data line SEG1 is supplied with the data line source potential Vs by the switch means SWs1 of the data line drive circuit 1005. Since the EL device EL11 is biased in the forward direction in this condition, a current path extending from the data line source potential Vs to the ground potential GND is formed. Thus, such a current I1 as shown in the drawing flows through the EL device EL11. Owing to the flow of the current I1 through the EL device EL11 in this way, the EL device EL11 is allowed to transition to the light emitting state.

The cathode of the EL device EL21, i.e., the scan line COM2 is supplied with the scan line source potential Vc by the switch means SWc2 of the scan line drive circuit 1003. Since there is no difference in potential between the anode and cathode of the EL device EL21 in this condition, a current path extending from the data line source potential Vs to the ground potential GND is not formed. Thus, since no current I1 flows through the EL device EL21, the EL device EL21 does not change to the light emitting state.

The cathode of the EL device EL12, i.e., the data line SEG2 is supplied with the ground potential GND by the switch means SWs2 of the data line drive circuit 1005. Since the anode of the EL device EL12 is not supplied with a current through the constant current device CC2, current I1 does not flow through the EL device EL12 and hence the EL device EL12 is not caused to transition to the light emitting state.

Similarly, the cathode of the EL device EL22, i.e., the data line SEG2 is supplied with the ground potential GND by the switch means SWs2 of the data line drive circuit 1005. Further, the cathode of the EL device EL22, i.e., the scan line COM2 is supplied with the scan line source potential Vc by the switch means SWc2 of the scan line drive circuit 1003. Since the EL device EL22 is biased in the reverse direction in this condition, no current I1 flows through the EL device EL22 and hence the EL device EL22 is not transitioned to the light emitting state.

While each of the EL devices is caused to transition to the light emitting state by being supplied with the current as described above, the amount of light emitted therefrom (the degree of light emitted) depends on a current value. When the amount of light emitted from each EL device falls outside a predetermined set value (corresponding to a standardized value set in consideration of an error), an intended display cannot be realized. Thus, the current values supplied to the respective data lines need to be constant values equal to one another. In order to keep constant the current values supplied to the data lines, the data line drive circuit 1005 is provided with the constant current devices CC1 through CCm. The constant current devices CC1 through CCm are supplied with a constant voltage at their gates, for example, and comprise MOS transistors operated in their saturated regions.

Since, however, variations and errors in manufacturing exist, the characteristics of all the MOS transistors that function as the constant current devices, do not necessarily fall within the set values (standardized values set in consideration of the errors). While, for example, a threshold voltage exists as one parameter indicative of the characteristic of each MOS transistor, a current Ids flowing between the drain and source of the MOS transistor also falls outside a set value where the threshold voltage takes values different from one another every MOS transistors respectively constituting the constant current devices. Thus, the current values supplied to the respective data lines are not brought to constant values equal to one another and vary each other. As a result, a problem arises in that the amounts of light emitted from the EL devices will vary every data lines.

Accordingly, there has been a demand for the advent of an improved drive circuit hard to be affected by the variations in manufacturing.

SUMMARY OF THE INVENTION

According to one aspect of the present invention, there is provided a drive circuit that includes an input node for receiving data, an output node. The drive circuit also includes a first MOS transistor of a first conductivity type and a second MOS transistor of the first conductivity type. The first MOS transistor has a source, a drain connected to the output node, and a gate connected to the input node. The second MOS transistor has a source, a drain connected to the source of the first MOS transistor, and a gate supplied with a predetermined potential level. The drive circuit also includes resistance means connected between the source of the second MOS transistor and a source node supplied with a source potential level.

DETAILED DESCRIPTION OF THE PREFERRED EMBODIMENTS

Figure 1:
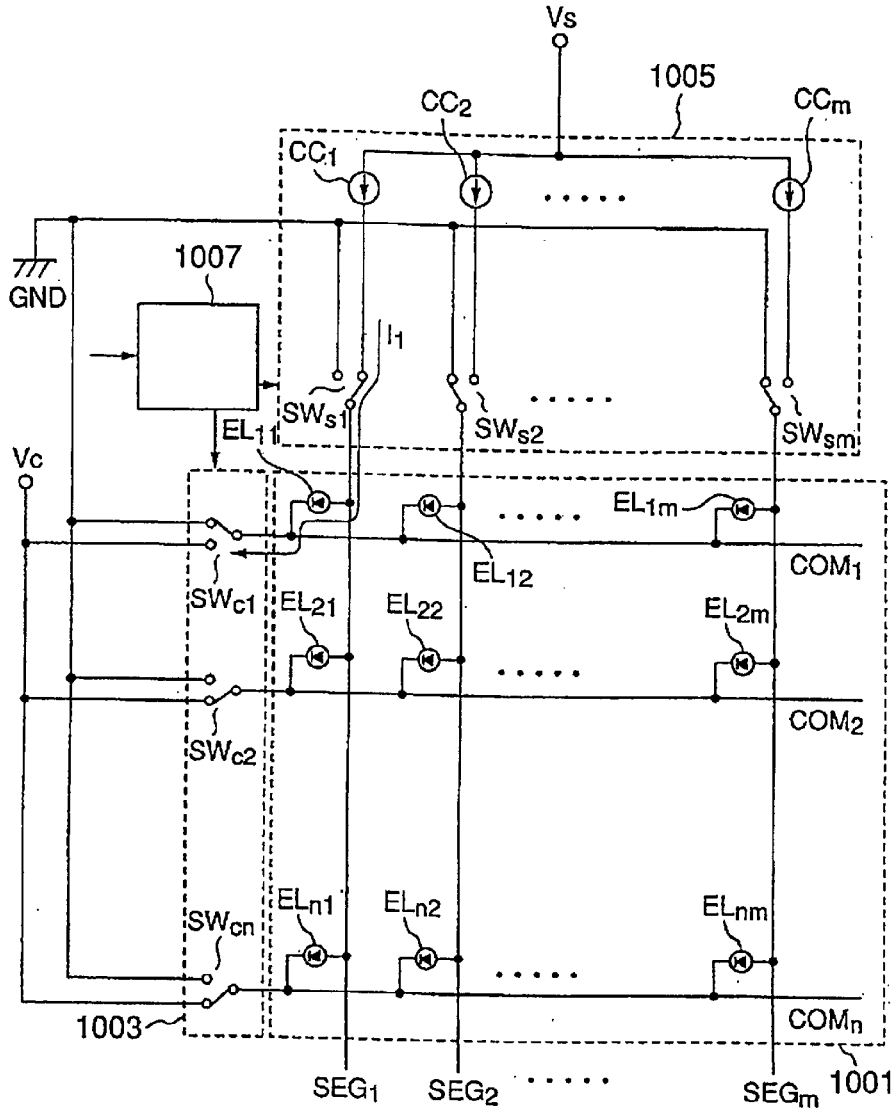
Fig. 1 PRIOR ART
FIG. 1 is a circuit diagram showing an outline of a general display unit using EL devices.

A semiconductor device according to preferred embodiments of the present invention will be explained hereinafter with reference to figures. In order to simplify explanation, like elements are given like or corresponding reference numerals through this specification and figures. Dual explanations of the same elements are avoided.

First Preferred Embodiment

Figure 2:
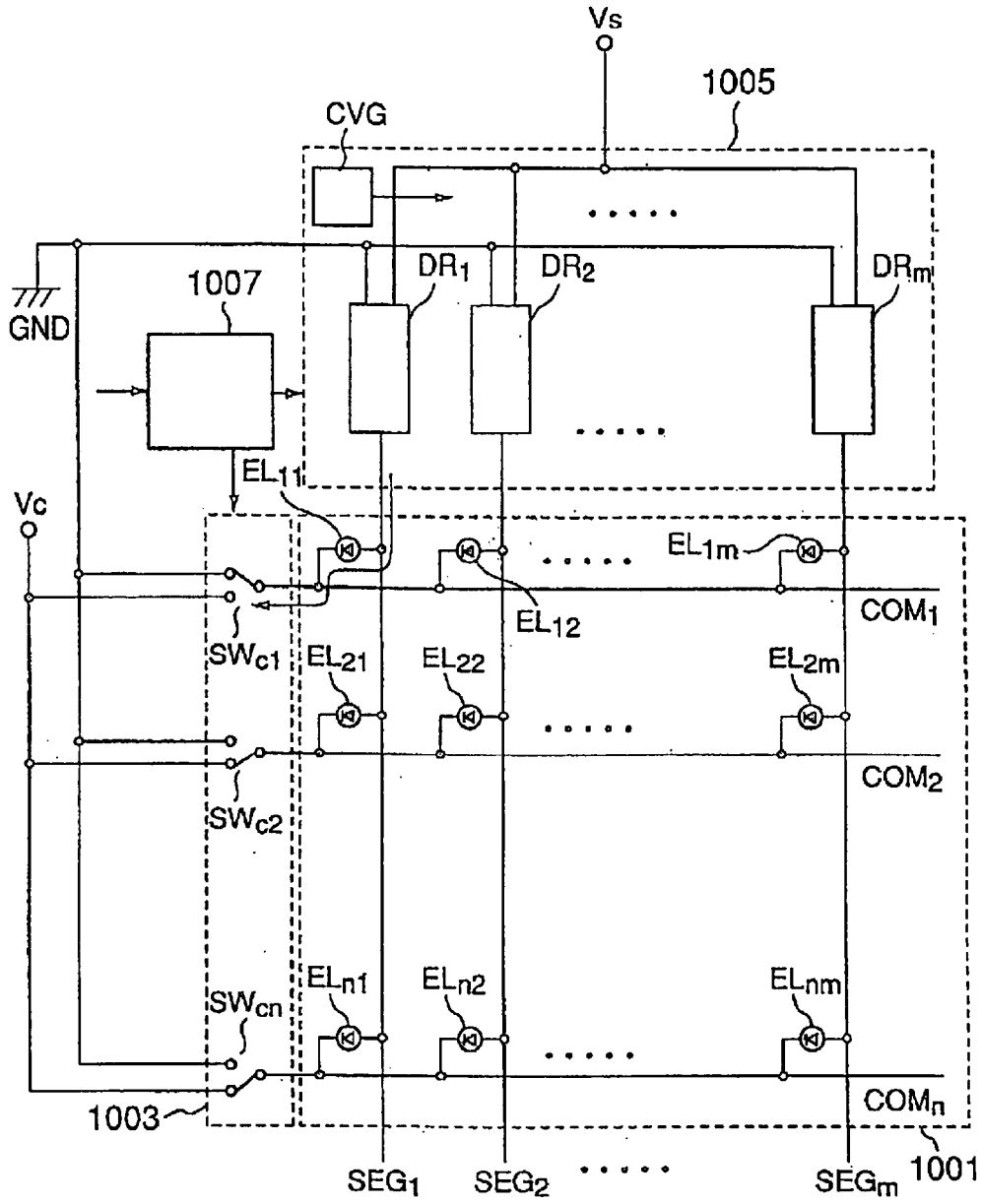
FIG. 2 is a circuit diagram showing an outline of a display unit including a drive circuit according to the present invention.

FIG. 2 is a circuit diagram showing the outline of a display unit including a drive circuit according to the present invention.

The difference between the display unit shown in FIG. 2 and the display unit shown in FIG. 1 resides in a data line drive circuit 1005.

The data line drive circuit 1005 is formed on a semiconductor chip and has data line drivers DR1 through DRm respectively electrically connected to a plurality of data lines SEG1 through SEGm. The data line drivers DR1 through DRm principally comprise a plurality of switch means SWs1 through SWsm and a constant voltage generator CVG.

Figure 3:
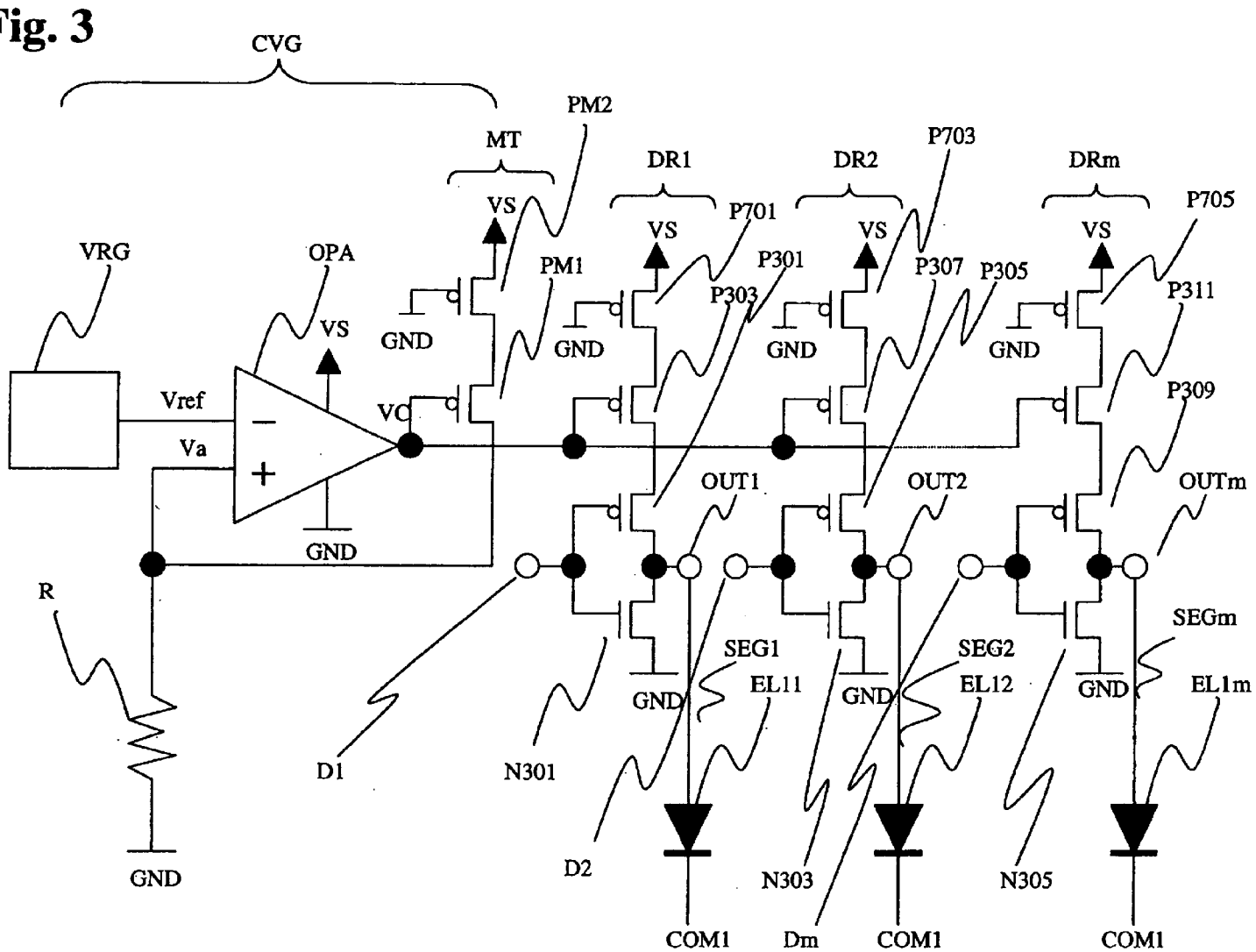
FIG. 3 is a detailed circuit diagram illustrating a data line drive circuit 1005 according to a first embodiment of the present invention.
Figure 4:
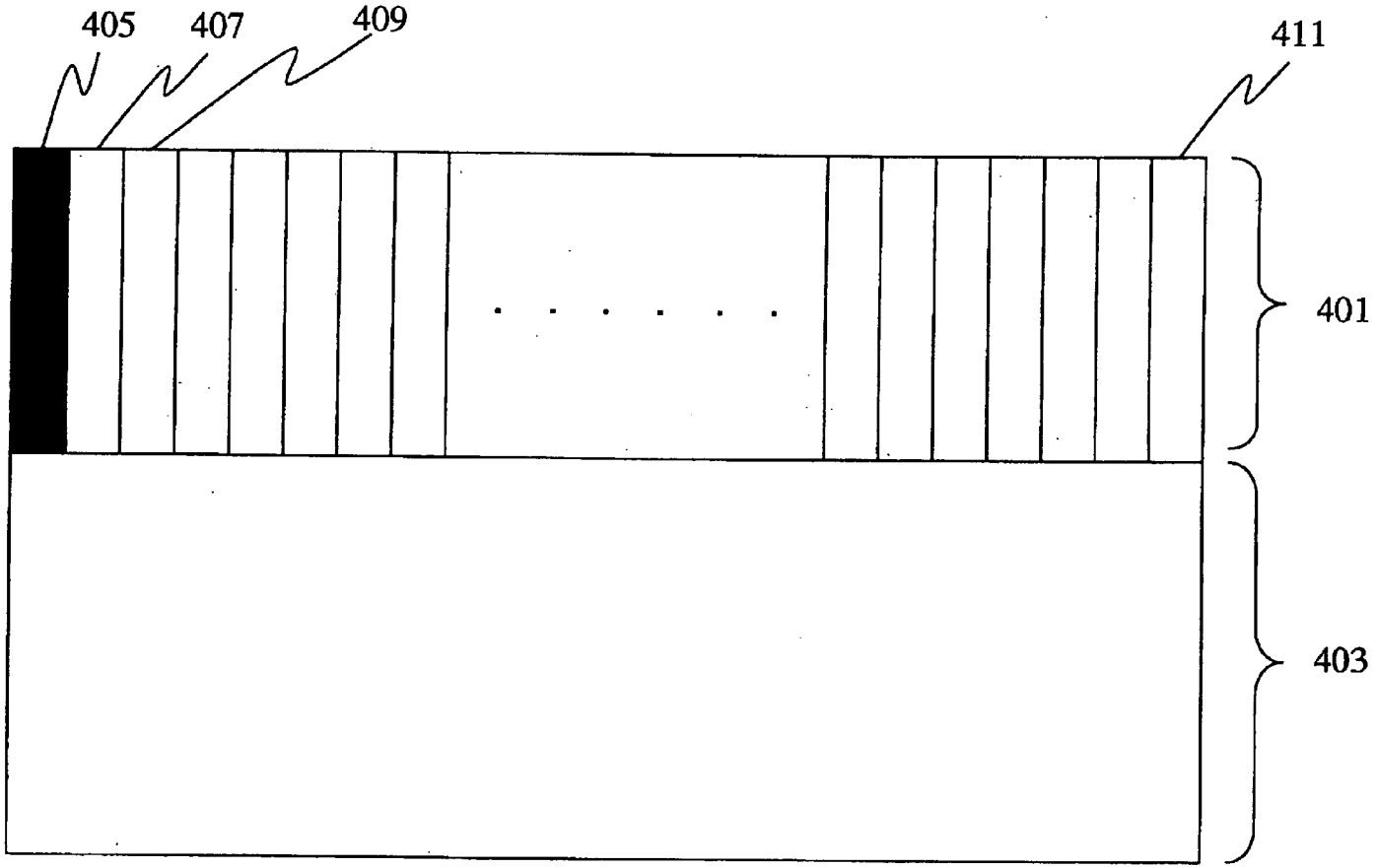
FIG. 4 is a layout diagram of the data line drive circuit 1005 formed on a semiconductor chip.

FIG. 3 is a detailed circuit diagram showing the data line drive circuit 1005, and FIG. 4 is a layout diagram of the data line drive circuit 1005 on the semiconductor chip.

The constant voltage generator CVG comprises a voltage reference generator VRG, an operational amplifier OPA, a resistor R, and a monitor MT.

The voltage reference generator VRG is formed in a control domain or region 403 and generates a predetermined voltage reference Vref.

The operational amplifier OPA is formed in the control region 403, for example and is connected between a data line source potential Vs (e.g., 20V) and a ground potential. Further, the operational amplifier OPA has an inversion terminal to which the voltage reference Vref is applied, a non-inversion terminal to which a voltage Va is applied, and an output terminal.

The monitor MT has a PMOS transistor PM1 and a PMOS transistor PM2. The PMOS transistor PM1 and the PMOS transistor PM2 are formed in a region 405 lying within a drive region 401. The PMOS transistor PM2 has a source connected to the data line source potential Vs, and a gate connected to the ground potential GND. While the PMOS transistor PM2 is normally kept in an ON state, it functions as a resistive element because it has a predetermined on resistance. The PMOS transistor PM1 has a source connected to the drain of the PMOS transistor PM2, a drain connected to the non-inversion input terminal of the operational amplifier OPA and a gate connected to the output terminal of the operational amplifier OPA.

The resistor R has one end connected to the non-inversion input terminal of the operational amplifier OPA and the other end connected to the ground potential GND. Incidentally, the resistor R is provided outside the semiconductor chip. However, the resistor R may be formed in the control region 403.

The data line driver DR1 has switch means SWs1, a PMOS transistor P303 used as a constant current device, and a PMOS transistor P701 used as resistance means.

The switch means SWs1 is connected to its corresponding data line SEG1 through an output terminal OUT1 and comprises a PMOS transistor P301 and an NMOS transistor N301. The PMOS transistor P301 has a source connected to its corresponding drain of the PMOS transistor P303, a drain connected to its corresponding drain of the NMOS transistor N301, and a gate connected to a data input terminal D1. The NMOS transistor N301 has a source connected to the ground potential GND, a drain connected to the drain of the PMOS transistor P301, and a gate connected to the data input terminal D1. The PMOS transistor P301 and the NMOS transistor N301 are formed in a region 407 lying within the drive region 401.

The PMOS transistor P303, which functions as the constant current device, is connected to the switch means SWs1. Described in detail, the PMOS transistor P303 has a source connected to its corresponding drain of the PMOS transistor P701, a drain connected to the source of the PMOS transistor P301, and a gate connected to the output terminal of the operational amplifier OPA. Since the gate of the PMOS transistor P303 is connected to the gate of the PMOS transistor PM1, these two transistors constitute a current mirror circuit Thus, a current corresponding to a ratio between a dimension (corresponding to a ratio W/L between the width of the gate of the PMOS transistor PM1 and the length of its gate) of the PMOS transistor PM1 and a dimension (corresponding to a ratio W/L between the width of the gate of the PMOS transistor P303 and the length of its gate) of the PMOS transistor P303 flows through the PMOS transistor P303. The PMOS transistor P303 is also formed in the region 407 lying within the drive region 401.

The PMOS transistor P701, which serves as resistance means, is connected to the PMOS transistor P303. Described in detail, the PMOS transistor P701 has a source connected to the data line source potential Vs, a drain connected to the source of the PMOS transistor P303, and a gate connected to the ground potential GND. While the PMOS transistor P701 is normally kept in an ON state, it functions as a resistive element because the PMOS transistor P701 has a predetermined on resistance. The PMOS transistor P701 is also formed in the region 407 lying within the drive region 401.

The data line driver DR2 includes switch means SWs2, a PMOS transistor P307 used as a constant current device, and a PMOS transistor P703 used as resistance means.

The switch means SWs2 is connected to its corresponding data line SEG2 through an output terminal OUT2 and comprises a PMOS transistor P305 and an NMOS transistor N303. The PMOS transistor P305 has a source connected to its corresponding drain of the PMOS transistor P307, a drain connected to the drain of the NMOS transistor N303, and a gate connected to a data input terminal D2. The NMOS transistor N303 has a source connected to the ground potential GND, a drain connected to the drain of the PMOS transistor P305, and a gate connected to the data input terminal D2. The PMOS transistor P305 and the NMOS transistor N303 are formed in a region 409 lying within the drive region 401.

The PMOS transistor P307, which functions as the constant current device, is connected to the switch means SWs2. Described in detail, the PMOS transistor P307 has a source connected to its corresponding drain of the PMOS transistor P703, a drain connected to the source of the PMOS transistor P305, and a gate connected to the output terminal of the operational amplifier OPA. Since the gate of the PMOS transistor P307 is connected to the gate of the PMOS transistor PM1, these two transistors constitute a current mirror circuit Thus, a current corresponding to a ratio between a dimension (corresponding to a ratio W/L between the width of the gate of the PMOS transistor PM1 and the length of its gate) of the PMOS transistor PM1 and a dimension (corresponding to a ratio W/L between the width of the gate of the PMOS transistor P307 and the length of its gate) of the PMOS transistor P307 flows through the PMOS transistor P307. The PMOS transistor P307 is also formed in the region 409 lying within the drive region 401.

The PMOS transistor P703, which serves as resistance means, is connected to the PMOS transistor P307. Described in detail, the PMOS transistor P703 has a source connected to the data line source potential Vs, a drain connected to the source of the PMOS transistor P307, and a gate connected to the ground potential GND. While the PMOS transistor P703 is normally kept in an ON state, it functions as a resistive element because the PMOS transistor P703 has a predetermined on resistance. The PMOS transistor P703 is also formed in the region 407 lying within the drive region 401.

The data line driver DRm has switch means SWsm, a PMOS transistor P311 used as a constant current device, and a PMOS transistor P705 used as resistance means.

The switch means SWsm is connected to its corresponding data line SEGm through an output terminal OUTm and comprises a PMOS transistor P309 and an NMOS transistor N305. The PMOS transistor P309 has a source connected to its corresponding drain of the PMOS transistor P311, a drain connected to its corresponding drain of the NMOS transistor N305, and a gate connected to a data input terminal Dm. The NMOS transistor N305 has a source connected to the ground potential GND, a drain connected to the drain of the PMOS transistor P309, and a gate connected to the data input terminal Dm. The PMOS transistor P309 and the NMOS transistor N305 are formed in a region 411 lying within the drive region 401.

The PMOS transistor P311, which functions as the constant current device, is connected to the switch means SWsm. Described in detail, the PMOS transistor P311 has a source connected to its corresponding drain of the PMOS transistor P705, a drain connected to the source of the PMOS transistor P309, and a gate connected to the output terminal of the operational amplifier OPA. Since the gate of the PMOS transistor P311 is connected to the gate of the PMOS transistor PM1, these two transistors constitute a current mirror circuit. Thus, a current corresponding to a ratio between a dimension (corresponding to a ratio W/L between the width of the gate of the PMOS transistor PM1 and the length of its gate) of the PMOS transistor PM1 and a dimension (corresponding to a ratio W/L between the width of the gate of the PMOS transistor P311 and the length of its gate) of the PMOS transistor P311 flows through the PMOS transistor P311. The PMOS transistor P311 is also formed in the region 411 lying within the drive region 401.

The PMOS transistor P705, which serves as resistance means, is connected to the PMOS transistor P311. Described in detail, the PMOS transistor P705 has a source connected to the data line source potential Vs, a drain connected to the source of the PMOS transistor P311, and a gate connected to the ground potential GND. While the PMOS transistor P705 is normally kept in an ON state, it functions as a resistive element since the PMOS transistor P705 has a predetermined on resistance. The PMOS transistor P705 is also formed in the region 407 lying within the drive region 401.

Figure 5:
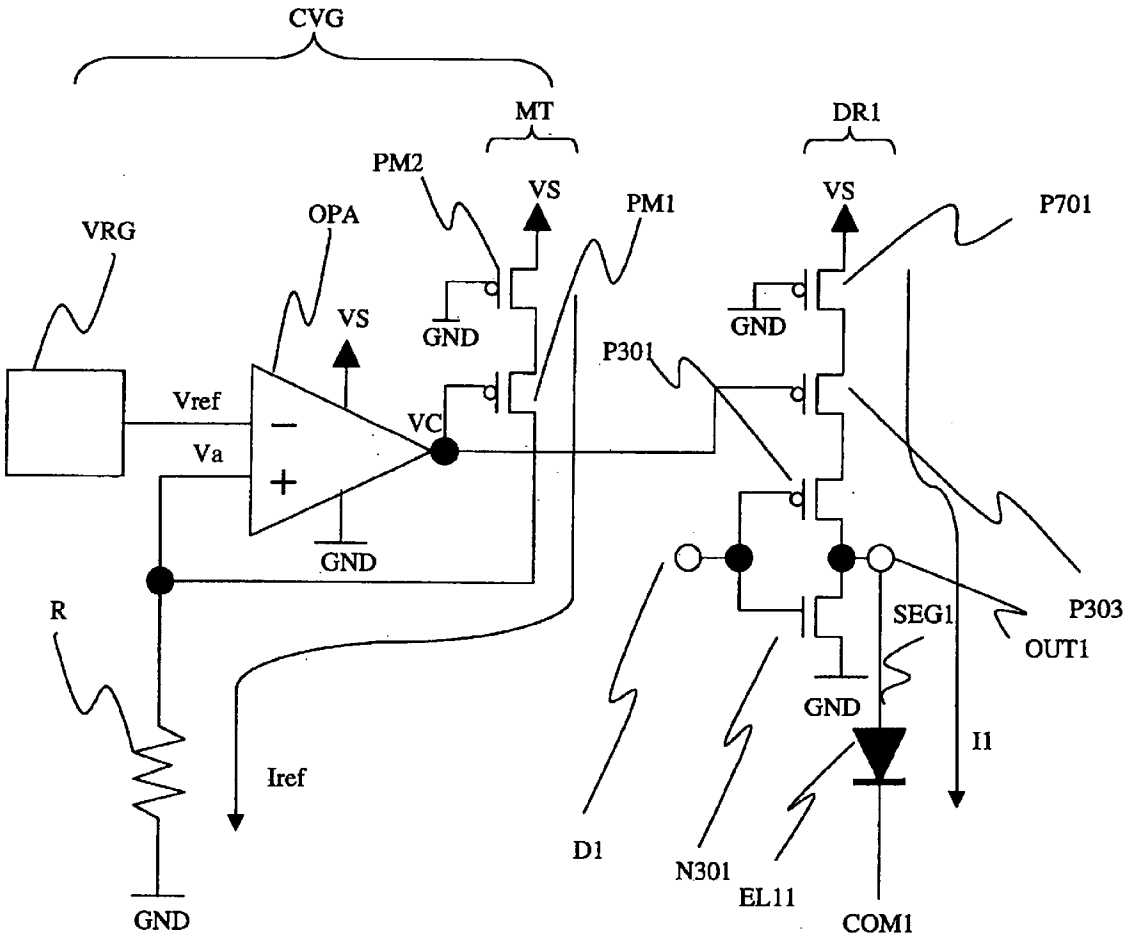
FIG. 5 is a circuit diagram depicting the data line drive circuit 1005 according to the first embodiment of the present invention.

The operation of the drive circuit 1005 will next be described. In order to provide an easy explanation, the operation of the drive circuit 1005 will be described using FIG. 5 in which a constant voltage generator CVG and a data line SEG1 are described.

The operation of the constant voltage generator CVG is as follows:

A potential Va developed across one end of a resistor R, i.e., a non-inversion input terminal of an operational amplifier OPA is represented by an expression (1).

$$Va = Iref * R \quad (1)$$

The potential Va is controlled by the operational amplifier OPA and a PMOS transistor PM1 so as to be equal to a potential Vref applied to an inversion input terminal of the operational amplifier OPA. The value of a current Iref that flows from a data line source potential Vs to a ground potential GND through the resistor R, id determined according to a gate-to-source voltage Vgs of the PMOS transistor PM1. Thus, the potential applied to the gate of the PMOS transistor PM1 is controlled in such a manner that the PMOS transistor PM1 supplies such a current Iref as to meet Va=Vref. At this time, the potential (corresponding to a potential outputted from the operational amplifier OPA) applied to the gate of the PMOS transistor PM1 is taken as Vc. (Operation at the non-light emission of EL device)

A control circuit 1007 outputs a data signal of a logic H level (e.g., 20V) to a data input terminal D1. When the logic H level is applied to the data input terminal D1, a PMOS transistor P301 is brought to an OFF state so that an NMOS transistor N301 is brought to an ON state. When the NMOS transistor N301 is turned ON, the potential applied to the anode of an EL device EL11 is brought to the ground potential GND because the data line SEG1 is electrically connected to the ground potential GND. Since, at this time, the PMOS transistor P301 is kept in the OFF state, the supply of a current to the EL device by a PMOS transistor P303 is not carried out. Since the potential applied to the anode of the EL device EL11 is given as the ground potential GND, the EL device EL11 is not allowed to transition to its light-emitting state no matter how the potential of a scan line COM1 reaches any potential. (Operation at the light emission of EL device)

The control circuit 1007 outputs a data signal of a logic L level (e.g., 0V) to the data input terminal D1. When the logic L level is applied to the data input terminal D1, the NMOS transistor N301 is brought to an OFF state so that the PMOS transistor P301 is brought to an ON state. When the NMOS transistor N301 reaches an OFF state, the data line SEG1 is electrically isolated from the ground potential GND. Since, at this time, the PMOS transistor P301 is kept in the ON state, the supply of a current I1 to the EL device by the PMOS transistor P303 is carried out. The current I1 that flows through the EL device, has a current value proportional to the current Iref supplied by the PMOS transistor PM1 of the monitor MT.

Figure 6:
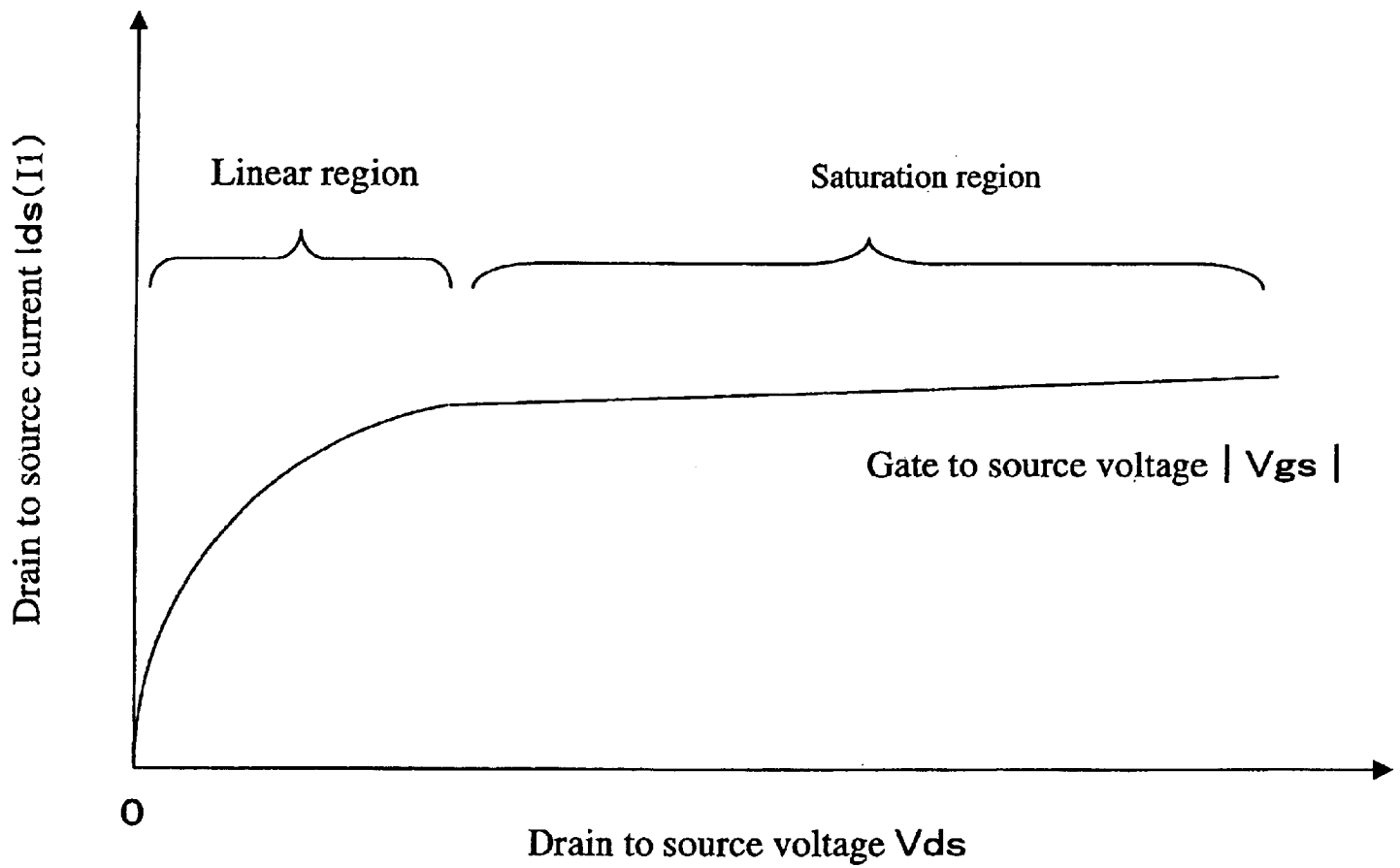
FIG. 6 is a diagram for describing an operating characteristic of a PMOS transistor P303.

As described previously, the amount of light emitted from the EL device depends on the current value. Thus, it is desirable to reduce a variation in the current I1 supplied to the data line SEG1 even if the potential of the data line SEG1 varies. In order to suppress such a current variation, a voltage Vgs applied between the gate and source of the PMOS transistor P303 and a voltage Vds applied between the drain and source thereof are set in such a manner that the PMOS transistor P303 is activated in such a saturated region as shown in FIG. 6. Since the PMOS transistor P303 is operated in the saturated region in this way, the current I1 supplied to the data line SEG1 can be kept approximately constant even if the drain-to-source voltage Vds slightly varies.

Let's now consider where a threshold voltage Vtp of the PMOS transistor P303 is out of a set value (corresponding to a standardized value set in consideration of an error) due to variations in manufacturing. A drain-to-source current Ids in a saturated region of a MOS transistor is represented by the following expression (2).

$$Ids=\mu W/2L*Cox\ (Vgs-|Vtp|)^2 \quad (2)$$

where $\mu$ indicates the mobility of a positive hole, W indicates a gate width, L indicates a gate length, Cox indicates gate capacity, Vgs indicates a gate-to-source voltage, and |Vtp| indicates the absolute value of a threshold voltage.

When the threshold voltage Vtp of the PMOS transistor P303 is increased by ΔVtp as viewed from the set value, the drain-to-source current Ids, i.e., the current I1 is reduced by ΔI1 from the set value, depending on ΔVtp as given by the expression (2). While a PMOS transistor P701 is held ON, it functions as a resistive element because it has a predetermined on-resistance value. Thus, when the current I1 is reduced by ΔI1, a voltage drop developed in the PMOS transistor P701 decreases depending on ΔI1. As a result, the gate-to-source voltage Vgs of the PMOS transistor P303 increases depending on ΔI1. As the gate-to-source voltage Vgs of the PMOS transistor P303 increases, the drain-to-source current Ids of the PMOS transistor P303, i.e., the current I1 increases. According to the above-described series of feedback operations, the decrease in ΔI1 is relaxed. In other words, the current I1 is corrected so as to approach the set value owing to the above-described series of feedback operations. Namely, the change in current due to the variations in manufacturing of each PMOS transistor is relaxed. Such feedback operations occur similarly even with respect to other data lines SEG2 through SEGm.

As described above, the current values I1 that flow through the respective data lines, are corrected so as to be approximately equal to one another. Thus, since the variations in current between the adjacent data lines are relaxed, it is possible to solve a problem that the amounts of light emitted from the EL devices, vary every data lines.

Second Preferred Embodiment

Figure 7:
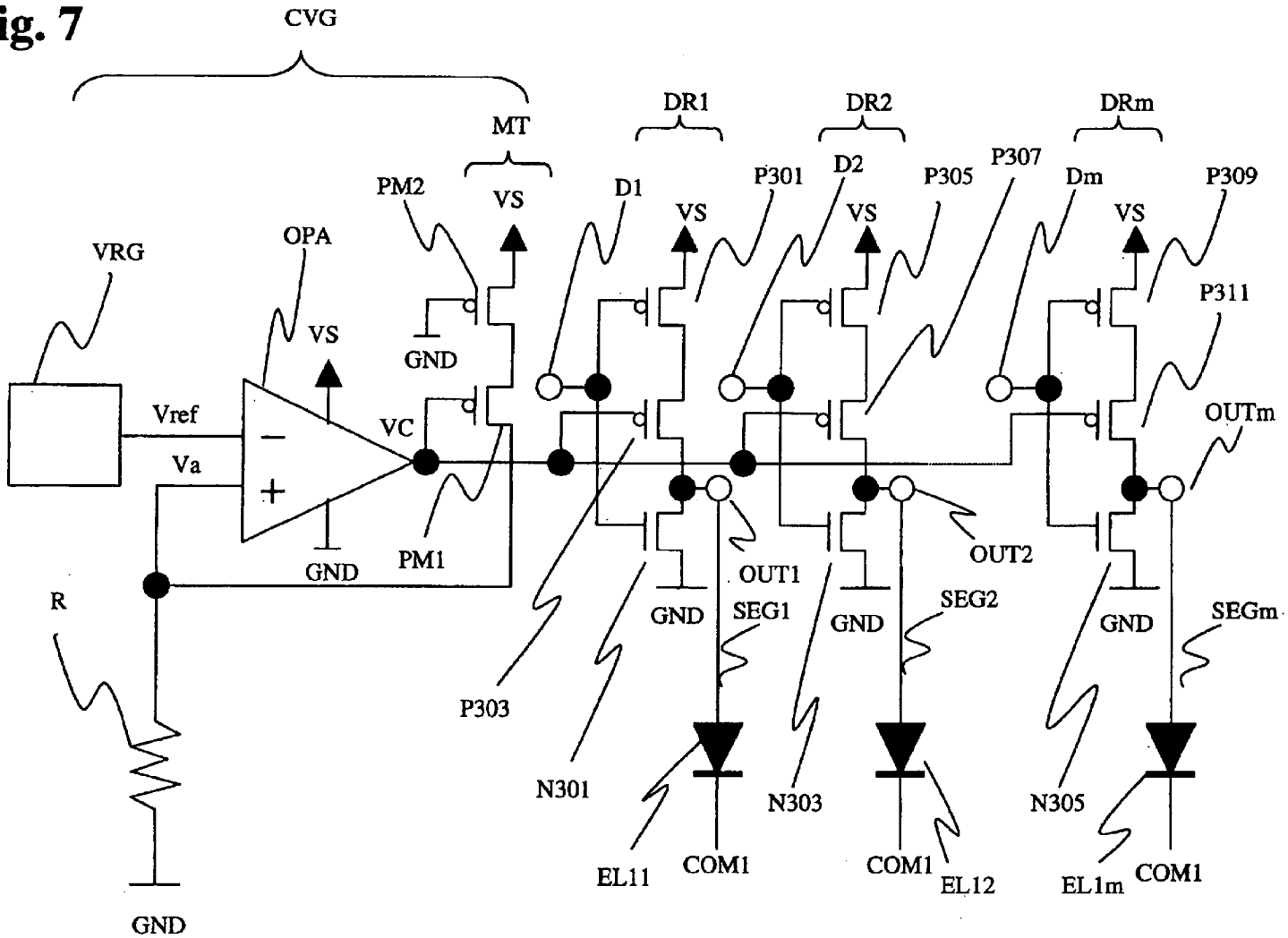
FIG. 7 is a detailed circuit diagram showing a data line drive circuit 1005 according to a second embodiment of the present invention.

FIG. 7 is a detailed circuit diagram showing a drive circuit according to a second embodiment of the present invention.

The difference between the drive circuit according to the second embodiment and the drive circuit according to the first embodiment resides in that PMOS transistors, which serve as constant current devices, are respectively provided between PMOS transistors each of which constitute switch means, and NMOS transistors each of which constitute switch means. Namely, the second embodiment is characterized in that the PMOS transistors that function as the switch means, are used even as the above-described resistance means.

FIG. 7 is a detailed circuit diagram showing a data line drive circuit 1005 according to the second embodiment of the present invention. FIG. 4 is a layout diagram of the data line drive circuit 1005 on the semiconductor chip. Incidentally, since the second embodiment and the first embodiment are identical to each other in basic layout on the semiconductor chip, the subsequent description will be made by reference to FIG. 4.

A constant voltage generator CVG comprises a voltage reference generator VRG, an operational amplifier OPA, a resistor R, and a monitor MT.

The voltage reference generator VRG is formed in a control domain or region 403 and generates a predetermined voltage reference Vref.

The operational amplifier OPA is formed in the control region 403, for example and is connected between a data line source voltage Vs (e.g., 20 V) and a ground potential. Further, the operational amplifier OPA has an inversion terminal to which the voltage reference Vref is applied, a non-inversion terminal to which a voltage Va is applied, and an output terminal.

The monitor MT has a PMOS transistor PM1 and a PMOS transistor PM2. The PMOS transistor PM1 and the PMOS transistor PM2 are formed in the region 405 lying within the drive region 401. The PMOS transistor PM2 has a source connected to the data line source potential Vs, and a gate connected to the ground potential GND. While the PMOS transistor PM2 is normally kept in an ON state, it functions as a resistive element because it has a predetermined on resistance. The PMOS transistor PM1 has a source connected to its corresponding drain of the PMOS transistor PM2, a drain connected to the non-inversion input terminal of the operational amplifier OPA and a gate connected to the output terminal of the operational amplifier OPA.

The resistor R has one end connected to the non-inversion input terminal of the operational amplifier OPA and the other end connected to the ground potential GND. Incidentally, the resistor R is provided outside the semiconductor chip. However, the resistor R may be formed in the control region 403.

A data line driver DR1 has switch means SWs1, and a PMOS transistor P303 used as a constant current device.

The switch means SWs1 is connected to its corresponding data line SEG1 through an output terminal OUT1 and comprises a PMOS transistor P301 and an NMOS transistor N301. The PMOS transistor P301 has a source connected to the data line source potential Vs, a drain connected to its corresponding source of the PMOS transistor P303, and a gate connected to a data input terminal D1. The NMOS transistor N301 has a source connected to the ground potential GND, a drain connected to its corresponding drain of the PMOS transistor P303, and a gate connected to the data input terminal D1. The PMOS transistor P301 and the NMOS transistor N301 are formed in the region 407 lying within the drive region 401.

The PMOS transistor P303, which functions as the constant current device, is connected to the switch means SWs1. Described in detail, the PMOS transistor P303 has a source connected to the drain of the PMOS transistor P301, a drain connected to the drain of the NMOS transistor N301, and a gate connected to the output terminal of the operational amplifier OPA. Since the gate of the PMOS transistor P303 is connected to the gate of the PMOS transistor PM1, these two transistors constitute a current mirror circuit. Thus, a current corresponding to a ratio between a dimension (corresponding to a ratio W/L between the width of the gate of the PMOS transistor PM1 and the length of its gate) of the PMOS transistor PM1 and a dimension (corresponding to a ratio W/L between the width of the gate of the PMOS transistor P303 and the length of its gate) of the PMOS transistor P303 flows through the PMOS transistor P303. The PMOS transistor P303 is also formed in the region 407 lying within the drive region 401.

A data line driver DR2 includes switch means SWs2, and a PMOS transistor P307 used as a constant current device.

The switch means SWs2 is connected to its corresponding data line SEG2 through an output terminal OUT2 and comprises a PMOS transistor P305 and an NMOS transistor N303. The PMOS transistor P305 has a source connected to the data line source voltage Vs, a drain connected to its corresponding source of the PMOS transistor P307, and a gate connected to a data input terminal D2. The NMOS transistor N303 has a source connected to the ground potential GND, a drain connected to its corresponding drain of the PMOS transistor P307, and a gate connected to the data input terminal D2. The PMOS transistor P305 and the NMOS transistor N303 are formed in the region 409 lying within the drive region 401.

The PMOS transistor P307, which functions as the constant current device, is connected to the switch means SWs2. Described in detail, the PMOS transistor P307 has the source connected to the drain of the PMOS transistor P305, the drain connected to the drain of the NMOS transistor N303, and a gate connected to the output terminal of the operational amplifier OPA. Since the gate of the PMOS transistor P307 is connected to the gate of the PMOS transistor PM1, these two transistors constitute a current mirror circuit Thus, a current corresponding to a ratio between a dimension (corresponding to a ratio W/L between the width of the gate of the PMOS transistor PM1 and the length of its gate) of the PMOS transistor PM1 and a dimension (corresponding to a ratio W/L between the width of the gate of the PMOS transistor P307 and the length of its gate) of the PMOS transistor P307 flows through the PMOS transistor P307. The PMOS transistor P307 is also formed in the region 409 lying within the drive region 401.

A data line driver DRm has switch means SWsm, and a PMOS transistor P311 used as a constant current device.

The switch means SWsm is connected to its corresponding data line SEGm and comprises a PMOS transistor P309 and an NMOS transistor N305. The PMOS transistor P309 has a source connected to the data line source potential Vs, a drain connected to its corresponding source of the PMOS transistor P311, and a gate connected to a data input terminal Dm. The NMOS transistor N305 has a source connected to the ground potential GND, a drain connected to its corresponding drain of the PMOS transistor P311, and a gate connected to the data input terminal Dm. The PMOS transistor P309 and the NMOS transistor N305 are formed in the region 411 lying within the drive region 401.

The PMOS transistor P311, which functions as the constant current device, is connected to the switch means SWsm. Described in detail, the PMOS transistor P311 has a source connected to the drain of the PMOS transistor P309, a drain connected to the drain of the NMOS transistor N305, and a gate connected to the output terminal of the operational amplifier OPA. Since the gate of the PMOS transistor P311 is connected to the gate of the PMOS transistor PM1, these two transistors constitute a current mirror circuit Thus, a current corresponding to a ratio between a dimension (corresponding to a ratio W/L between the width of the gate of the PMOS transistor PM1 and the length of its gate) of the PMOS transistor PM1 and a dimension (corresponding to a ratio W/L between the width of the gate of the PMOS transistor P311 and the length of its gate) of the PMOS transistor P311 flows through the PMOS transistor P311. The PMOS transistor P311 is also formed in the region 411 lying within the drive region 401.

Figure 8:
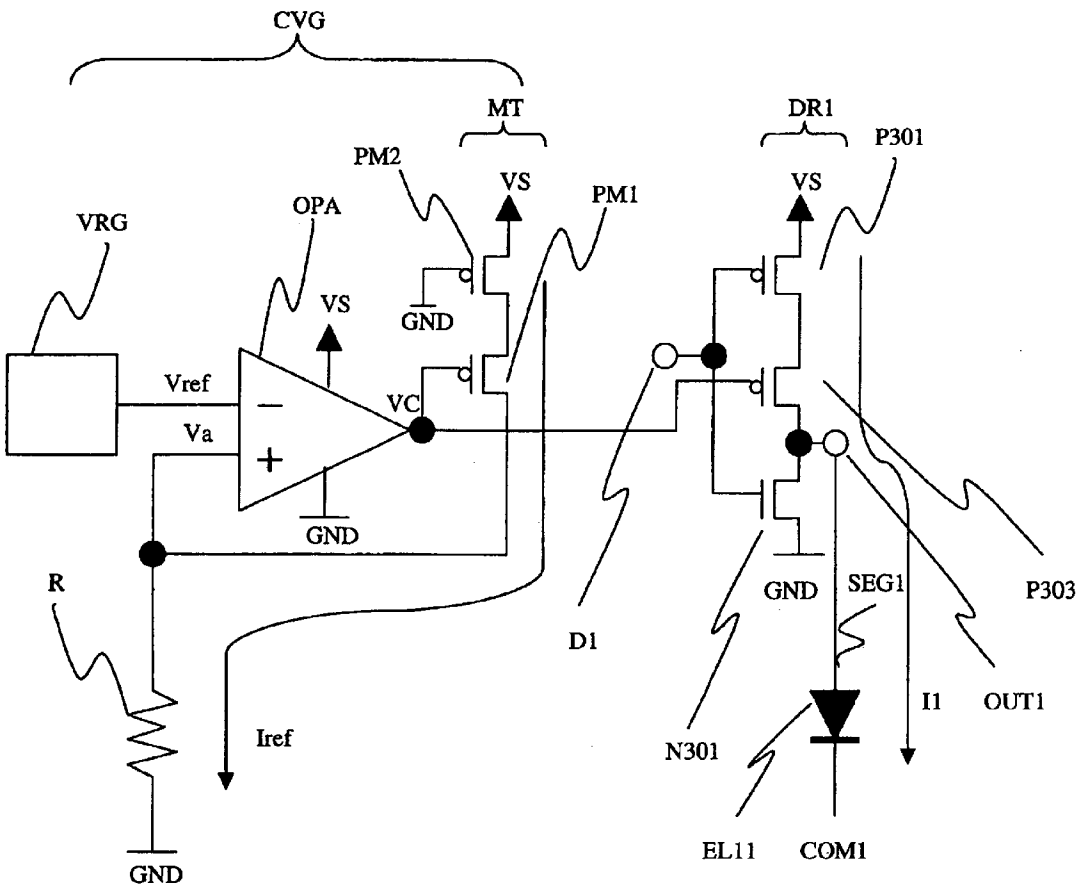
FIG. 8 is a circuit diagram illustrating the data line drive circuit 1005 according to the second embodiment of the present invention.

The operation of the drive circuit 1005 according to the second embodiment of the present invention will next be described. In order to provide an easy explanation, the operation of the drive circuit 1005 will be described using FIG. 8 in which a constant voltage generator CVG and a data line SEG1 are described.

The operation of the constant voltage generator CVG is as follows:

A potential Va developed across one end of a resistor R, i.e., a non-inversion input terminal of an operational amplifier OPA is represented by the expression (1).

The potential Va is controlled by the operational amplifier OPA and a PMOS transistor PM1 so as to be equal to a potential Vref applied to an inversion input terminal of the operational amplifier OPA. The value of a current Iref that flows from a data line source potential Vs to a ground potential GND through the resistor R, is determined according to a gate-to-source voltage Vgs of the PMOS transistor PM1. Thus, the potential applied to the gate of the PMOS transistor PM1 is controlled in such a manner that the PMOS transistor PM1 supplies such a current Iref as to meet Va=Vref. At this time, the potential (corresponding to a potential outputted from the operational amplifier OPA) applied to the gate of the PMOS transistor PM1 is taken as Vc.

(Operation at the Non-Light Emission of EL Device)

A control circuit 1007 outputs a data signal of a logic H level (e.g., 20 V) to a data input terminal D1. When the logic H level is applied to the data input terminal D1, a PMOS transistor P301 is brought to an OFF state so that an NMOS transistor N301 is brought to an ON state. Since the data line SEG1 is electrically connected to the ground potential GND when the NMOS transistor n301 is brought to the On state, the potential applied to the anode of an EL device EL11 is brought to the ground potential GND. Since, at this time, the PMOS transistor P301 is kept in the OFF state, the supply of a current to an EL device by a PMOS transistor P303 is not carried out. Since the potential applied to the anode of the EL device EL11 is given as the ground potential GND, the EL device EL11 is not caused to transition to its light-emitting state no matter how the potential of a scan line COM1 reaches any potential.

(Operation at the Light Emission of EL Device)

The control circuit 1007 outputs a data signal of a logic L level (e.g., 0V) to the data input terminal D1. When the logic L level is applied to the data input terminal D1, the NMOS transistor N301 is brought to an OFF state so that the PMOS transistor P301 is brought to an ON state. When the NMOS transistor N301 reaches an OFF state, the data line SEG1 is electrically isolated from the ground potential GND. Since, at this time, the PMOS transistor P301 is kept in the ON state, the supply of a current I1 to the EL device by the PMOS transistor P303 is carried out. The current I1 that flows through the EL device, has a current value proportional to the current Iref supplied by the PMOS transistor PM1 of a monitor MT.

As described previously, the amount of light emitted from the EL device depends on the current value. Thus, it is desirable to reduce a variation in the current I1 supplied to the data line SEG1 even if the potential of the data line SEG1 varies. In order to suppress such a current variation, a voltage Vgs applied between the gate and source of the PMOS transistor P303 and a voltage Vds applied between the drain and source thereof are set in such a manner that the PMOS transistor P303 is activated in such a saturated region as shown in FIG. 6. For instance, the output potential Vc of the operational amplifier OPA is set so as to take about 17V and the drain-to-source voltage Vds is set so as to take about 3V. Since the PMOS transistor P303 is operated in the saturated region in this way, the current I1 supplied to the data line SEG1 can be kept approximately constant even if Vds slightly varies.

Let's now consider where a threshold voltage Vtp of the PMOS transistor P303 falls outside a set value (corresponding to a standardized value set in consideration of an error) due to variations in manufacturing. A drain-to-source current Ids in a saturated region of a MOS transistor is represented by the aforementioned expression (2).

When the threshold voltage Vtp of the PMOS transistor P303 is increased by ΔVtp as viewed from the set value, the drain-to-source current Ids, i.e., the current I1 is reduced by ΔI1 from the set value, depending on ΔVtp as given by the expression (2). While the PMOS transistor P301 is held ON, it functions as a resistive element because it has a predetermined on-resistance value. Thus, when the current I1 is reduced by ΔI1, a voltage drop developed in the PMOS transistor P301 also decreases depending on ΔI1. As a result, the gate-to-source voltage Vgs of the PMOS transistor P303 increases depending on ΔI1. As the gate-to-source voltage Vgs of the PMOS transistor P303 increases, the drain-to-source current Ids of the PMOS transistor P303, i.e., the current I1 increases as represented by the expression (2). The current I1 is corrected so as to approach the set value owing to the above-described series of feedback operations. Namely, the change in current due to the variations in manufacturing of each PMOS transistor is relaxed. Such feedback operations occur similarly even with respect to other data lines SEG2 through SEGm.

As described above, the current values I1 that flow through the respective data lines, are corrected so as to be approximately equal to one another. Thus, since the variations in current between the adjacent data lines are relaxed, it is possible to solve a problem that the amounts of light emitted from the EL devices, vary every data lines.

In the drive circuit according to the second embodiment as well, the PMOS transistor P301, which functions as the switch means SWs1, functions even as resistance means for implementing the feedback operations. Described in detail, the on resistance of the PMOS transistor P301 is utilized as resistance means for correcting a manufacturing error of the PMOS transistor P301 that functions as the constant current device.

Thus, since the drive circuit according to the second embodiment is in no need of special elemental devices or devices for correcting variations in manufacturing of the PMOS transistor, the number of elemental devices can be reduced as compared with the first embodiment. As a result, variations in current between the adjacent data lines can be suppressed without increasing a circuit area.

Figure 9:
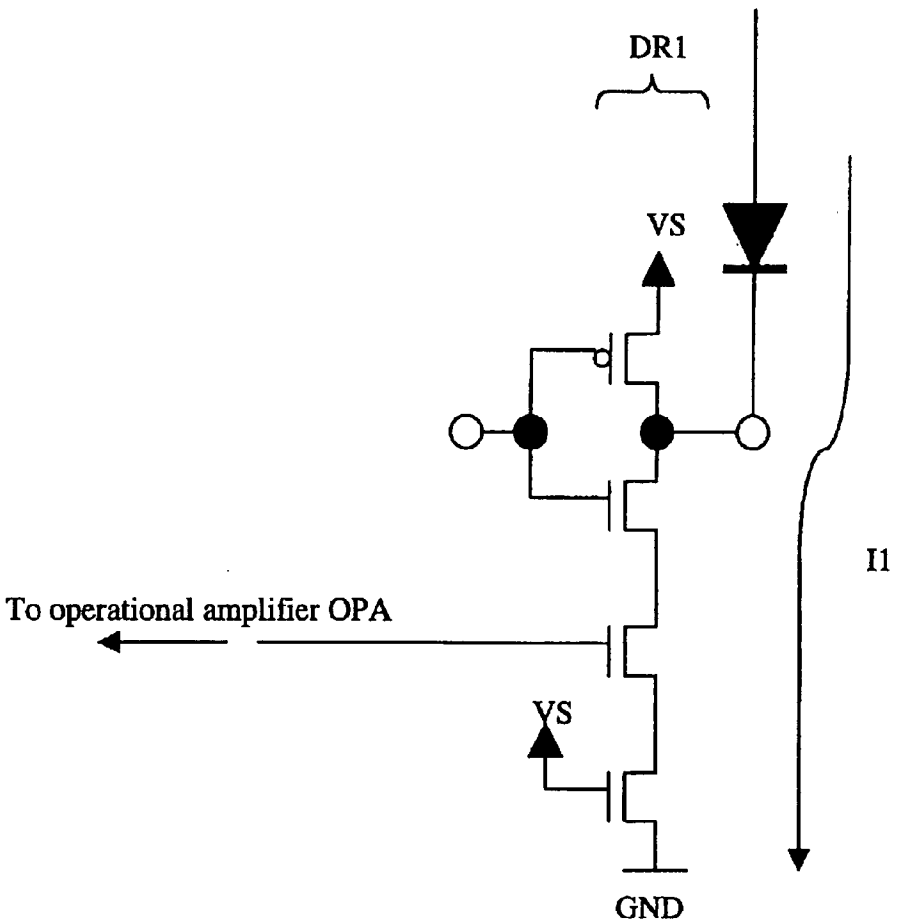
FIG. 9 is a circuit diagram showing a modification of the data line drive circuit according to the first embodiment of the present invention.

Incidentally, the first embodiment has described as an illustrative example, such a display unit that a current is supplied to a display elemental device to thereby execute a display operation. However, the present invention is applicable even to a display unit of such a type that a current is sucked (drawn) from a display elemental device to thereby execute a display operation. In this case, the data line driver DR1 takes such a configuration as shown in FIG. 9. Namely, an NMOS transistor normally kept in an ON state, which functions as resistance means, is provided on the source side of an NMOS transistor which constitutes a constant current device.

Figure 10:
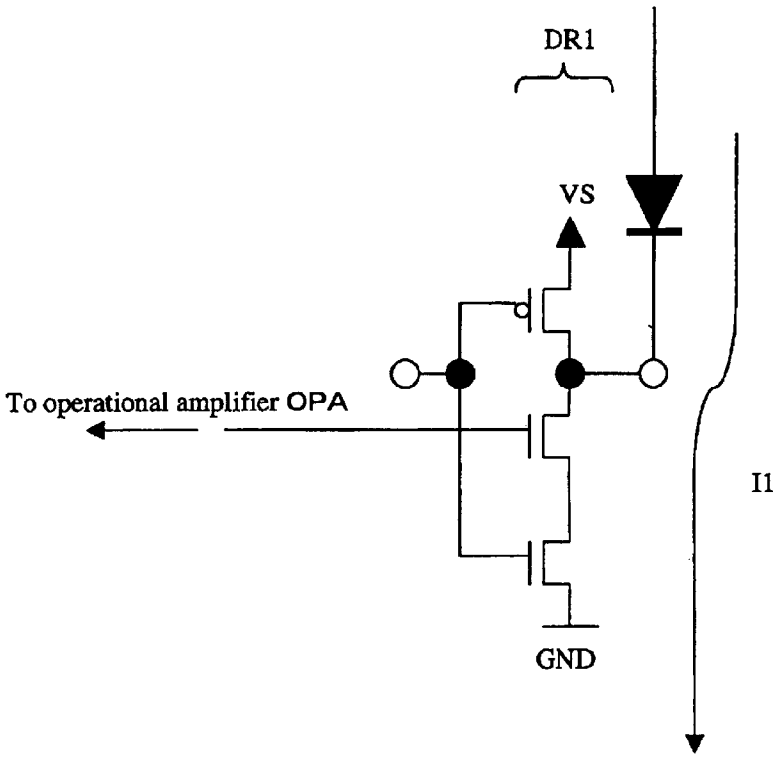
FIG. 10 is a circuit diagram illustrating a modification of the data line drive circuit according to the second embodiment of the present invention.

Further, the second embodiment has also described, as an illustrative example, such a display unit that a current is supplied to a display elemental device to thereby execute a display operation. However, the present invention is applicable even to a display unit of such a type that a current is sucked (drawn) from a display elemental device to thereby execute a display operation. In this case, the data line driver DR1 takes such a configuration as shown in FIG. 10. Namely, an NMOS transistor, which constitutes switch means that functions even as resistance means, is provided on the source side of an NMOS transistor which constitutes a constant current device.

While the drive circuits according to the respective embodiments described above drive the EL devices, the objects to be driven are not limited to the EL devices. Each of the objects to be driven by the drive circuit may be a display body supplied with a current so as to transition to a display state.

A summary of an advantageous effect obtained by a typical one of the inventions disclosed in the present application will be described below in brief as follows:

According to a drive circuit of the present invention, the provision of resistive means on the source side of a MOS transistor constituting constant current means makes it possible to suppress a substantial shift of a constant current value from a set value due to a manufacturing characteristic error of the MOS transistor constituting the constant current means. As a result, the values of currents that flow through respective data lines, are corrected so as to become approximately equal to one another. Thus, a problem that the amounts of light emitted from EL devices vary every data lines, can be solved because a variation in current between the data lines is relaxed.

While the preferred form of the present invention has been described, it is to be understood that modifications will be apparent to those skilled in the art without departing from the spirit of the invention. The scope of the invention is to be determined solely by the following claims.

What is claimed is:

1. A drive circuit comprising:

an input node for receiving data;

an output node;

a first MOS transistor of a first conductivity type, the first MOS transistor having a source, a drain connected to the output node, and a gate supplied with a predetermined potential level; and a second MOS transistor of the first conductivity type, the second MOS transistor having a source connected to a source node supplied with a source potential level, a drain connected to the source of the first MOS transistor, and a gate connected to the input node.

2. The drive circuit according to claim 1, further including a third MOS transistor of a second conductivity type, the third MOS transistor having a source connected to a ground node supplied with a ground potential level, a drain connected to the output node, and a gate connected to the input node.

3. The drive circuit according to claim 1, wherein the first MOS transistor supplies a constant current to the output node.

4. A drive circuit comprising:

an input node for receiving data;

an output node;

a first MOS transistor of a first conductivity type, the first MOS transistor having a source, a drain connected to the output node, and a gate supplied with a predetermined potential level; and a second MOS transistor of the first conductivity type, the second MOS transistor having a source connected to a ground node supplied with a ground potential level, a drain connected to the source of the first MOS transistor, and a gate connected to the input node.

5. The drive circuit according to claim 4, further including a third MOS transistor of a second conductivity type, the third MOS transistor having a source connected to a source node supplied with a source potential level, a drain connected to the output node, and a gate connected to the input node.

6. The drive circuit according to claim 4, wherein the first MOS transistor supplies a constant current to the output node.

* * * * *